US006991323B1

(12) United States Patent
Temple et al.

(10) Patent No.: US 6,991,323 B1
(45) Date of Patent: Jan. 31, 2006

(54) MULTI-CHANNEL ARRAY DROPLET DEPOSITION APPARATUS

(75) Inventors: Stephen Temple, Cambridge (GB); Mark Richard Shepherd, Royston (GB)

(73) Assignee: Xaar Technology Limited, Cambridge (GB)

( * ) Notice: Subject to any disclaimer, the term of this patent is extended or adjusted under 35 U.S.C. 154(b) by 57 days.

(21) Appl. No.: 08/536,345

(22) Filed: Sep. 29, 1995

Related U.S. Application Data

(63) Continuation of application No. 08/167,894, filed as application No. PCT/GB92/01085 on Jun. 17, 1992, now Pat. No. 5,463,414.

(30) Foreign Application Priority Data

Jun. 17, 1991 (GB) ..... 9113023

(51) Int. Cl.
*B41J 2/045* (2006.01)

(52) U.S. Cl. ..... 347/68; 347/69

(58) Field of Classification Search ..... 347/68, 347/69, 71; 228/179.1, 182
See application file for complete search history.

(56) References Cited

U.S. PATENT DOCUMENTS

| | | | | |
|---|---|---|---|---|
| 3,245,895 A | | 4/1966 | Baker et al. | 204/164 |
| 4,493,137 A | | 1/1985 | Bader et al. | 29/25.35 |
| 4,828,870 A | | 5/1989 | Ando et al. | 427/38 |
| 4,992,808 A | * | 2/1991 | Bartky et al. | 346/140 R |
| 4,997,673 A | | 3/1991 | Ogata et al. | 427/38 |
| 5,016,028 A | * | 5/1991 | Temple | 346/140 R |
| 5,053,245 A | | 10/1991 | Kiyama et al. | 427/38 |
| 5,235,352 A | | 8/1993 | Pies et al. | 346/140 R |
| 5,406,319 A | | 4/1995 | Hayes et al. | 347/71 |
| 5,463,414 A | | 10/1995 | Temple et al. | 347/68 |
| 5,598,196 A | | 1/1997 | Braun | 347/68 |
| 5,619,235 A | | 4/1997 | Suzuki et al. | 347/69 |

FOREIGN PATENT DOCUMENTS

| | | |
|---|---|---|
| DE | G 84 14 967.1 | 3/1986 |
| DE | 40 16 501 | 6/1994 |
| EP | 277703 A1 | 8/1988 |
| EP | 341929 A2 | 11/1989 |
| EP | 0 364 136 A2 | 4/1990 |
| EP | 364136 A3 | 4/1990 |
| EP | 566875 | 10/1993 |
| EP | 0 484 983 | 9/1996 |
| WO | WO 92/22429 | 12=1992 |

OTHER PUBLICATIONS

Laser Deposition of AlN Thin Films on InP and GaAs, Bhattacharya et al., Japanese Journal of Applied Physics vol. 30, No. 10A, Oct., 1991, pp. L1750-L1752.
Printout, vol. 14, No. 8, Aug. 1990, pp. 12-13.

* cited by examiner

*Primary Examiner*—Christopher Mahoney
(74) *Attorney, Agent, or Firm*—Marshall, Gerstein & Borun LLP

(57) ABSTRACT

A multi-channel array droplet deposition apparatus has a base sheet comprising a layer of piezo-electric material poled normal thereto, an array of parallel, open-topped droplet liquid channels provided by upstanding channel separating walls formed in the layer, electrodes on channel facing surfaces of the walls, a channel closure sheet bonded to the walls, nozzles respectively communicating with the channels and a droplet liquid supply connecting with the channels, the closure sheet having an array of parallel conductive tracks thereon paced at intervals corresponding with the channel spacing and located parallel to and opposite the channels and bonds, which preferably are solder bonds, mechanically and electrically connect each track to the electrodes of the channel facing walls of the channels opposite thereto and seal the closure sheet to the channels.

42 Claims, 3 Drawing Sheets

MULTI-CHANNEL ARRAY DROPLET DEPOSITION APPARATUS

CROSS-REFERENCE TO RELATED APPLICATION

This is a continuation of U.S. application Ser. No. 08/167,894 filed Feb. 15, 1994, now U.S. Pat. No. 5,463,414 issued Oct. 31, 1995, which is the U.S. national phase of International Application No. PCT/GB92/01085 filed Jun. 17, 1992.

BACKGROUND OF THE INVENTION

This invention relates to multi-channel array droplet deposition apparatus and to a method of manufacture thereof.

In U.S. Pat. Nos. 4,887,100; 4,992,808; 5,003,679; and 5,028,936 there is disclosed multi-channel array droplet deposition apparatus, suitably, for use as drop-on-demand ink jet printheads and of the form comprising an array of parallel channels mutually spaced transversely to the channels in the array direction. These printheads employ piezoelectric actuators forming at least part of the channel separating side walls as the means for effecting droplet expulsion from nozzles communicating respectively with the channels. One preferred method of making such a printhead comprises providing a base sheet having a layer of piezoelectric material poled normal thereto, forming a multiplicity of parallel grooves in the layer of piezoelectric material so that the material affords channel separating walls between adjacent grooves, the ink channels thus being provided by the grooves, forming electrodes on the channel facing surfaces of the walls so that the actuating electric fields are applied normal to the direction of poling in the array direction to produce deflection of the walls in the direction of the applied fields, connecting electrical drive circuits to the electrodes, bonding a top sheet to the walls to close the ink channels, providing nozzles for the respective channels and further providing ink supply means communicating with the channels.

In one design, the channels separating walls comprise piezoelectric, so-called, "chevron" actuators in which upper and lower parts of the walls are oppositely poled so as to deflect into chevron form transversely to the corresponding channels. One method of forming the base sheet from which the channels and channel separating wall actuators are formed consists of using a five layer laminate as disclosed in PCT International Publication No. WO 92/09436. In an alternative design, there are employed, so-called, "cantilever" actuators which are disclosed in U.S. Pat. No. 5,016,028. In U.S. patent application Ser. No. 08/480,541 filed Jun. 7, 1995 and counterpart PCT International Publication No. WO 91/17051 there is disclosed an array of parallel ink channels formed from a number of like modules each having a multiplicity of parallel ink channels, the modules being serially butted together. In a preferred form pairs of the butted modules form an ink channel at the butting location.

SUMMARY OF THE INVENTION

It is a general object of the present invention to provide a multi-channel array, droplet deposition apparatus of improved construction and an improved method of manufacturing said apparatus. Another object is to enable the provision of a multi-channel array droplet deposition apparatus which can operate at lower voltage for a given compliance of the channel wall actuators.

It is a further object of one form of the present invention to provide a multi-channel array, droplet deposition apparatus and a method of manufacture thereof in which the integrity of the chip connections to the tracks which connect with the channel electrodes is not threatened by thermal cycling of the printhead.

The present invention consists in a method of manufacturing a multi-channel array droplet deposition apparatus which comprises providing a base sheet having a layer of piezoelectric material poled normal to said sheet, forming an array of parallel, open-topped droplet liquid channels in said base sheet layer so that the piezoelectric material provides upstanding walls separating successive channels, the walls having respective channel facing surfaces forming electrodes on said channel facing surfaces, bonding a channel closure sheet to the walls, providing nozzles respectively communicating with the channels and providing means for connecting a source of droplet liquid to the channels, characterised by forming said channel closure sheet with an array of parallel conductive tracks spaced at intervals corresponding with respective spacing of said channels, locating each track in position parallel with and opposite a corresponding one of said channels, and sealing the closure sheet to the channel walls by forming bonds which mechanically and electrically connect each of said tracks to the electrodes on said channel facing surfaces of the walls of said corresponding channel. Preferably, the method includes connecting drive current circuits to the tracks prior to forming said bonds to connect each of the tracks to the electrodes on said channel facing surfaces of the walls of said corresponding channel. Advantageously, the method includes forming said bonds as solder bonds. Preferably, the method includes depositing solder on either or both the tracks and the electrodes, locating the channels opposite the tracks and simultaneously forming the bonds to connect the tracks each to the electrodes of the channel facing surfaces of the walls of the corresponding channel. Also the method preferably includes heating at least the solder thereby to cause the solder to wet the tracks and the adjoining electrodes thereby to form a meniscus bridging the tracks and adjoining electrodes and cooling the solder to form said bonds.

Advantageously, the method also includes forming said tracks on said channel closure sheet of width approximately equal to respective spacings of the electrodes on the channel facing surfaces.

The invention further consists in a multi-channel array droplet deposition apparatus comprising a base sheet having a layer of piezoelectric material poled normal thereto, an array of parallel, open topped, droplet liquid channels in said base sheet layer provided by upstanding channel separating walls formed in said layer the wall having respective channel facing surfaces, electrodes provided on said channel facing surfaces, a channel closure sheet bonded to the walls, nozzles respectively communicating with the channels and means for supplying droplet liquid to the channels, characterised in that said channel closure sheet has an array of parallel conductive tracks thereon spaced at intervals corresponding with respective spacings of said channels and each disposed parallel with and opposite a corresponding one of the channels and bonds mechanically and electrically connect each track to the electrodes on the channel facing surfaces of the corresponding channel and seal the closure sheet to the channels. Suitably, electric drive current circuits are connected respectively to the tracks. Advantageously, the tracks on the channel closure sheet are of width approaching that of the spacing between the electrodes on the channel facing walls. Preferably, the bonds connecting the tracks to the electrodes are solder bonds. Advantageously, the solidus of the solder of the bonds is selected, having regard to the values of the thermal expansion coefficients, to limit the relative thermal strains of the channel closure sheet and said piezoelectric material. The solder can be an alloy of lead and/or tin and/or indium. One alloy which may be employed comprises lead and tin. In a preferred form the solder is a eutectic alloy including lead and tin. In a further form the solder alloy includes silver.

Suitably, the channel closure sheet comprises a glass or ceramic having a relatively high elastic modulus compared with that of piezoelectric ceramic and an expansion coefficient matched to that of <110> silicon. A preferred material for the channel closure sheet is borosilicate glass. This type of closure sheet may have deposited thereon a layer of crystalline silicon extending the width of the sheet in the channel array direction said layer of silicon having formed therein a multiplexer drive circuit having input and output terminals of which the output terminals are connected to the conductive tracks on the channel closure sheet.

BRIEF DESCRIPTION OF THE DRAWINGS

The invention will now be described by way of example by reference to the accompanying diagrams.

In the drawings like parts are referred to by the same reference numerals.

DESCRIPTION OF THE PREFERRED EMBODIMENTS

Figure 1:
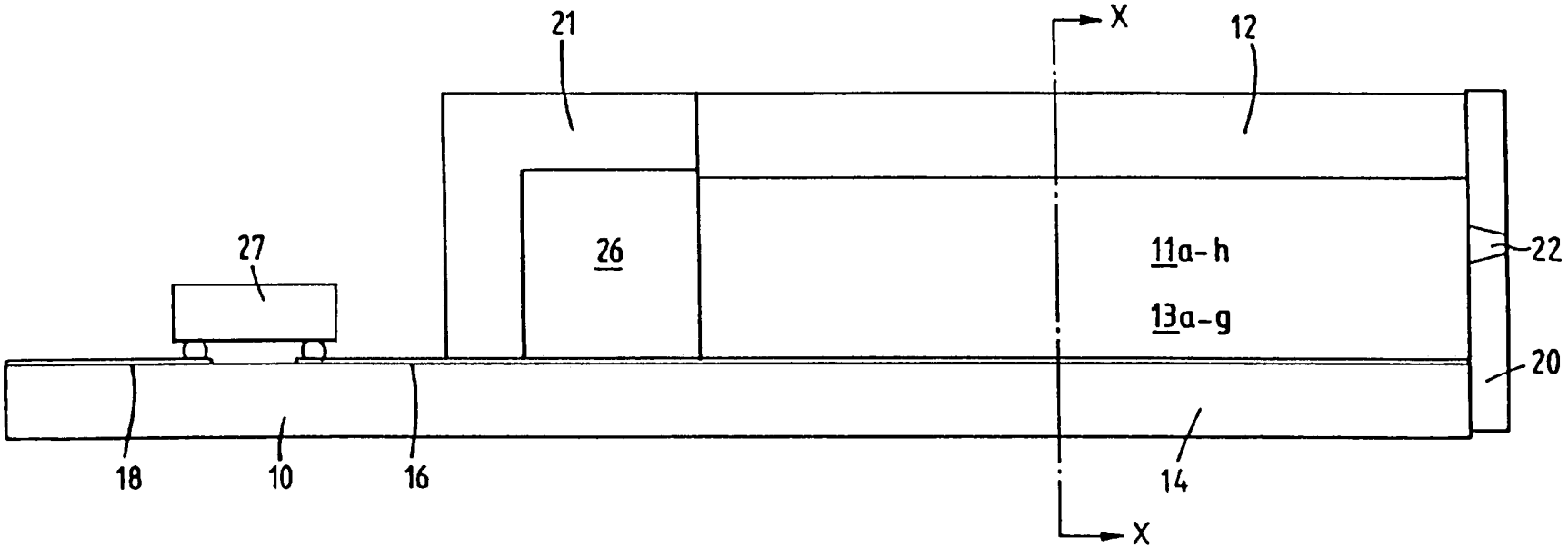
FIG. 1 shows a longitudinal section of a droplet deposition apparatus in the form of a drop-on-demand ink jet printhead constructed in accordance with the invention.
Figure 2:
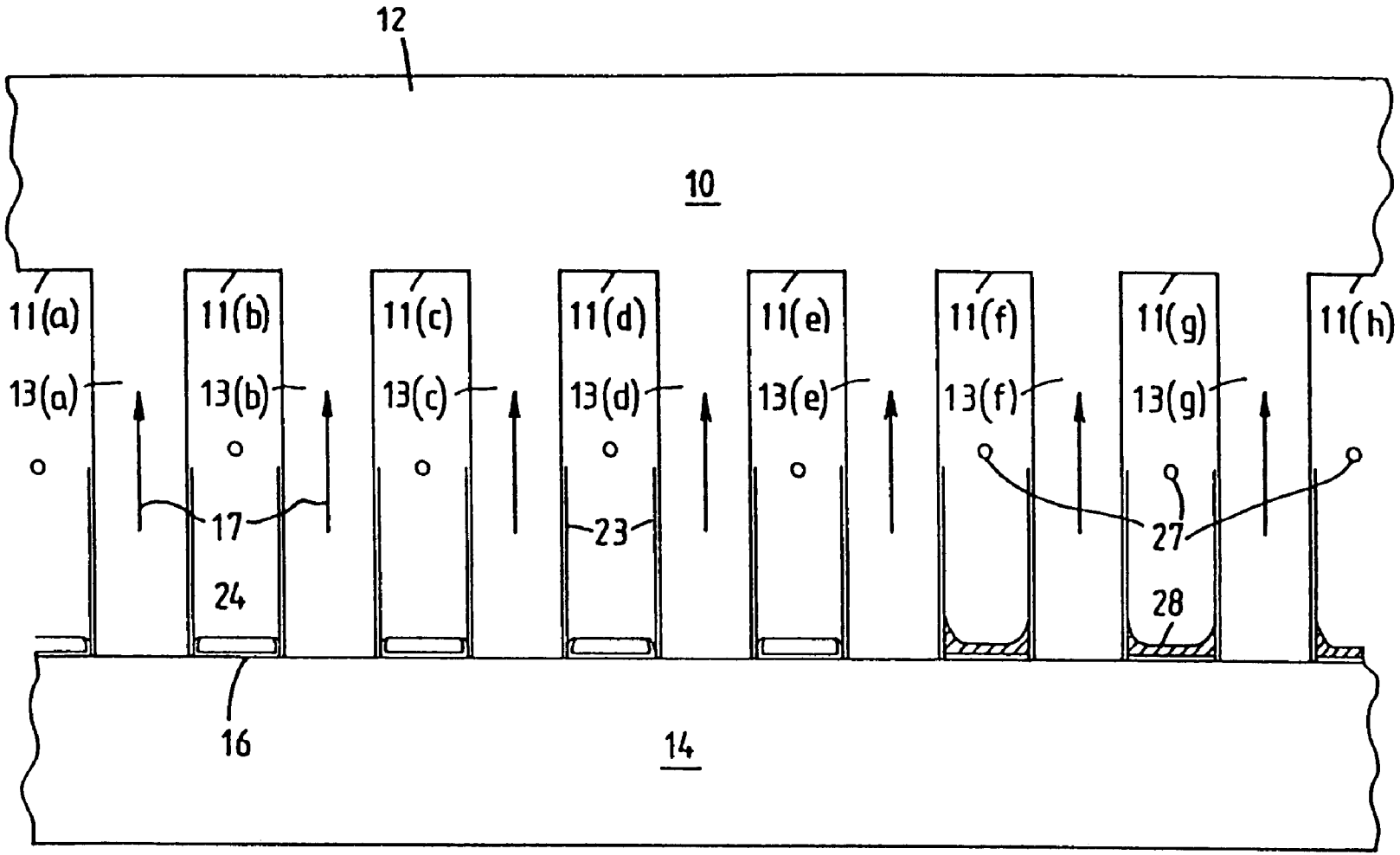
FIG. 2 shows a section in the array direction on the line X—X of FIG. 1 of one form of the printhead.
Figure 3:
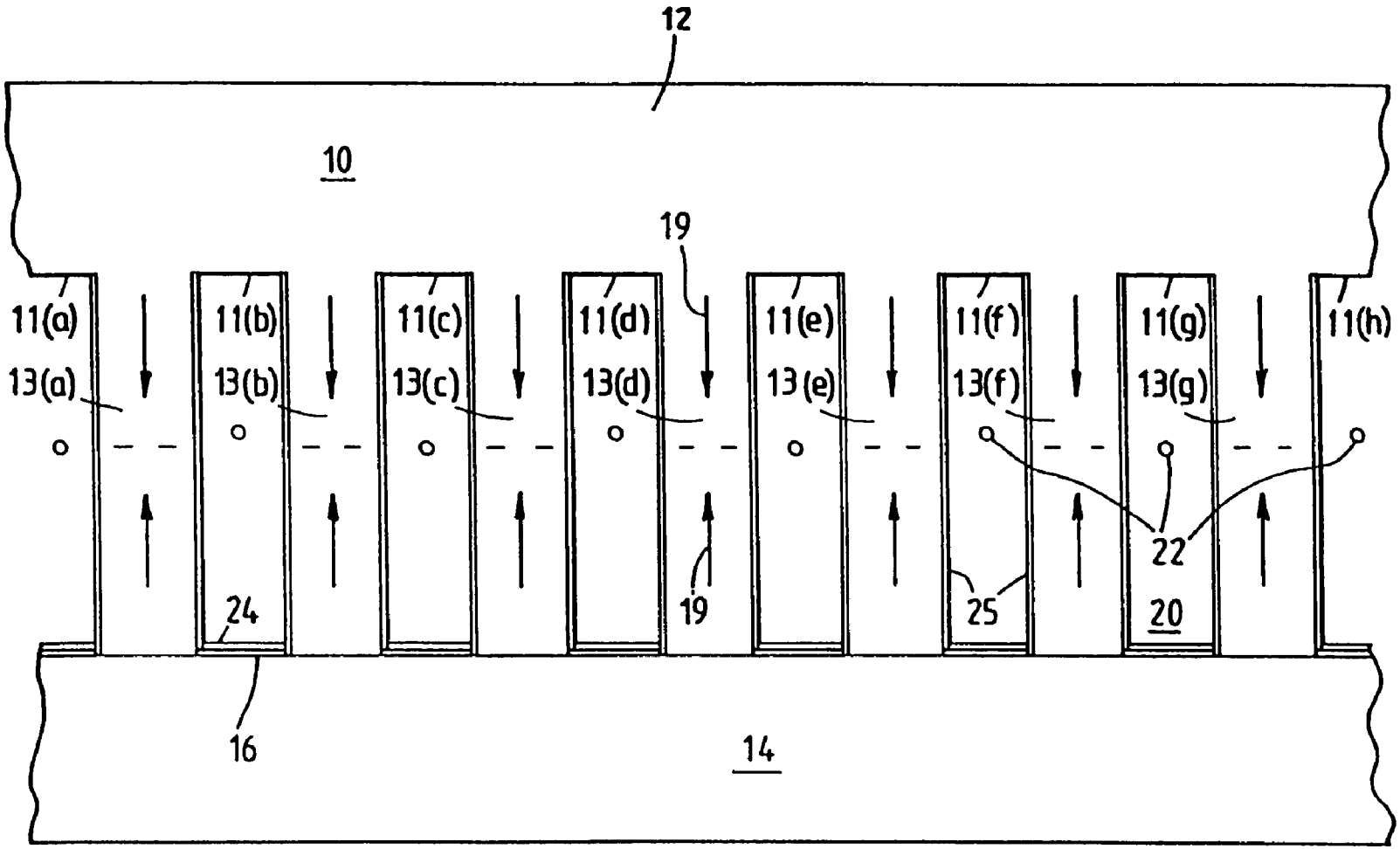
FIG. 3 shows a section in the array direction on the line X—X of FIG. 1 of another form of the printhead.

FIGS. 1 to 3 illustrate forms of ink jet array printhead which are assembled according to the principles of the invention. The printheads are of the drop-on-demand type incorporating channel dividing wall actuators. These actuators are formed in a sheet of piezoelectric ceramic poled in a direction perpendicular to the sheet and operated in shear mode so that the actuators deflect in the direction of the electric field applied thereto.

The drawings illustrate a printhead 10 in which an array of ink channels 11(*a*) . . . 11(*h*), separated by channel separating wall actuators 13(*a*) . . . 13(*g*) formed in a sheet of piezoelectric ceramic 12, are bonded to a substrate or channel closure sheet 14. The substrate has parallel conductive tracks 16 formed thereon at the same pitch interval as the ink channels. The tracks 16 are connected to drive chip 27 and conduct electric drive signals directed from the chip to the actuators, generally as described in U.S. Pat. Nos. 4,887,100; 4,992,808; 5,003,679; and 5,028,936, which introduced this class of drop-on-demand printhead and the contents of which are herein incorporated by reference. Some aspects of the construction are further disclosed in U.S. patent application Ser. No. 08/480,541 filed Jun. 7, 1995 and counterpart PCT International Publication No. WO 91/17051 the contents of which are also incorporated herein by reference. The drive chip 27 is also connected to tracks 18 at one end of the closure sheet 14 on which are provided input clock, power waveform and print data signals.

The ink channels of the printhead are terminated at corresponding ends thereof by nozzles 22 formed in nozzle plate 20 which is attached to the piezoelectric ceramic sheet 12 and the channel closure sheet 14 remote from the chip 27.

A manifold 21 is attached at the end of the channels adjacent the drive chip 27 to hold ink and deliver it into the printhead channels via the transverse duct 26.

The construction and operation of typical forms of printhead in accordance with the invention are disclosed in more detail with reference to FIGS. 2 and 3, which show alternative designs in enlargements on section X—X of FIG. 1. FIG. 2 illustrates a printhead which incorporates a cantilever actuator as described in U.S. Pat. No. 5,016,028 the contents of which are incorporated herein by reference and in which the piezoelectric ceramic is polarised perpendicular to the piezoelectric sheet in a single orientation and in which the electrodes 23, which may be formed of a suitable metal such as an alloy of nickel and chromium, for example, on the wall actuators extend along the lengths of corresponding sidewalls and about half the extent of the wall height: and FIG. 3 illustrates a chevron actuator made from a piezoelectric laminate as disclosed in PCT International Publication No. WO 92/09436 the contents of which are incorporated herein by reference and for which the electrodes 25 extend the full height of the wall actuators which are formed of two oppositely poled parts in the upper and lower halves of the walls respectively formed in two piezoelectric ceramic sheets poled in the thickness direction thereof. The direction of poling is given by arrow 17 in FIG. 2 and by arrows 19 in FIG. 3.

An essential feature of the construction, which is illustrated in FIGS. 2 and 3, is that the tracks 16 which each extend substantially the distance between, as the case may be, the electrodes 23 or 25 are coated with a film of solder 24. The electrodes on the actuator walls may also be coated with a thin layer of solder. This layer assists the solder when heated above its liquidus to wet the electrodes. The channel array is mounted so that the ink channels are located parallel with and respectively opposite the soldered tracks and the actuator walls occupy the spaces which separate the tracks. When the solder is heated it molts and flows forming a meniscus 28 of solder, which connects electrically and mechanically the electrodes on the walls on both sides of each channel to the tracks on the substrate or closure sheet 14 at the same time sealing the ink channel walls to the substrate 14 in ink tight manner.

The solidus of the solder of the bonds is selected having regard to the values of the thermal expansion coefficients to limit the relative thermal strains of the closure sheet and the piezoelectric material and can be an alloy of lead and/or tin and/or indium. One suitable alloy comprises lead and tin and is preferably a eutectic alloy thereof. A further suitable form of solder alloy includes silver.

The advantages of this construction are that it provides improvements both in manufacture and performance of the printhead. These combine to reduce the printhead cost.

In manufacture this construction is conveniently simplified because it combines an electronic substrate component and a printhead component that can be fabricated and tested separately. When both work satisfactorily in test, then the assembly of working components is made by a solder bond: this is a rapid step capable of automation and high yield in manufacture. Further the assembly can be tested. Since the chip can in one design be part of the substrate component, a reduction of the component count may then be obtained.

One fault that has been observed to occur on a printhead component is that the continuity of the plating on a small number of electrode walls is sometimes interrupted by a crack or by local shading of the electrodes and the track during the plating process possibly by dust. Because, if applied to the electrodes, the solder, since it wets both the electrodes associated with the track, will bridge this sort of defect, the present construction is seen to be self repairing with respect to this fault condition. In previous designs the chips were assembled to the completed printhead. As a consequence a faulty connection or a faulty chip reduced the assembly yield. The application of the channel closure sheet by glue bonding also took time for the glue bond to cure and frequently proved to be variable in quality. The yield of the cover bonding process thus was deleterious to the overall assembly yield. Broken plating, which is difficult to find by inspection, was also a cause of faulty production. Printhead assembly employing a solder connection process as described avoids these defects and has consequently improved yield.

Where the printhead comprises an array of like modules it will be preferred that the substrate channel closure sheet will generally be made in one piece the full width of the array. The piezoelectric components, however, are formed of a width appropriate to the supply of piezoelectric material (PZT) wafers and the yield of the channel forming and plating processes. It will be evident that the number of tracks operated by each chip on the substrate closure sheet and the width of the piezoelectric components assembled to it can be made independently without any width correspondence between the chips and the active components at the butted joins, as was a feature of PCT Patent Application No. PCT/GB91/00720. The multiple chips in the array can conveniently be operated by one set of input signal tracks 18 instead of one set of tracks per chip.

A further advantageous property of the solder bond is that it holds the walls rigidly to the substrate channel closure sheet, preventing movement of the actuator walls both torsionally in flexure and laterally in shear. Further, if the tracks are formed on a rigid substrate, rotation of the tops of the walls is secured preventing tip flexure. In the case of glue bonds sealing the walls to a channel closure sheet, however, it has been observed that the tops of the actuator walls deform to such a degree that a pin joint is effectively formed at the tops of the walls. This occurs due to the relatively low stiffness of a glue compared with that of the solder and the actuator ceramic.

The advantage of a rigid joint as opposed to a pin joint bond is illustrated by the following table of performance calculations for a chevron actuator such as is depicted in FIG. 3.

| | Voltage Volts | Compliance Ratio | Wall Height μm | Wall Width μm | Channel Width μm |
|---|---|---|---|---|---|
| Pin Joint | 27.5 | 0.353 | 375 | 87 | 80 |
| Rigid Joint | 18.9 | 0.360 | 420 | 87 | 80 |

Calculations show that the wall height, to obtain a specified compliance ratio, of the actuator is greater by about 13% when the bond corresponds to a rigid joint as opposed to a pin joint. The actuation voltage is also reduced by about 27%.

A lower actuating voltage makes it possible to work at a lower actuation energy and also to employ a chip made by a cheaper process. Less heat is also generated in the array during actuation.

In order to take best advantage of these aspects of the printhead design it is preferred that the substrate channel closure sheet 14 should be formed of a material which has a relatively rigid elastic modulus and possesses a thermal expansion coefficient that is closely matched to the piezoelectric ceramic component. While the elastic modulus of PZT is about 50 GPa and the solder modulus is also comparable, that of the substrate is preferably greater. The expansion coefficient of PZT tends to be variable depending on the supply source and process history, but is preferably matched to that of the substrate to about 1 part per $10^6$ per ° C. These thermal expansion objectives are met by the use of a borosilicate glass substrate such as PYREX borosilicate glass (Corning 7740) or equivalent materials. Since the elastic modulus of this glass exceeds 200 GPa, the substrate is effectively rigid.

When the substrate channel closure sheet is a borosilicate glass, whose expansion coefficient matches that of silicon in the <110> direction, the chip can be integrated on the substrate. First a layer of crystalline silicon is deposited over the width of the glass substrate in the region of the chip 27. The logic and power transistors of the multiplexer drive circuits are then formed directly on the silicon layer. The tracks 16 and 18 are then deposited so that connections are made respectively with the input and output terminals of the drive circuit. This drive circuit is a multiplexer circuit substantially as described in U.S. Pat. No. 5,028,812. In this way the drive circuit is formed directly on the glass substrate instead of the chips being made on a silicon wafer, diced into separate chips and bonded as components into the tracks on the substrate.

The deposition of chips on glass has been practised for other applications such as display products and is advantageous provided the manufacturing yield for the chip on glass process is sufficiently great, so that manufacture and assembly of separate components by discrete chip assembly processes is unjustified.

A further advantage in the manufacture of the piezoelectric ceramic sheet described is that machining tolerances are found to be relaxed when the tracks are formed on a separate substrate channel closure sheet. The channel depth tolerance is greater than that which is possible in the prior art processes referred to where shallow connection grooves are formed in alignment with the channels and separated therefrom by respective bridge sections. Because the channels of the construction which is described herein are of uniform depth throughout, control of the thickness tolerance of the PZT layer can be relaxed. As a result only the top face of the piezoelectric sheet needs to be ground to a flatness suitable for bonding. The control of parallelness between opposite faces of the PZT layer can also be relaxed. The cost of grinding one face is less than that of lapping both faces parallel. Another advantage during assembly is that connecting the substrate and the piezoelectric sheet with a low temperature solder is a rapid step involving melting and solidfying the solder, instead of, as in the prior art, curing the bond material, which requires a substantially longer cycle time: at the same time the solder as it wets, holds the tracks and the electrodes of each part automatically in alignment and draws them together with a pressure equal to a few atmospheres, avoiding the need for assembly jigs. The design enables automated assembly.

The construction also introduces features that provide improved yield in manufacture and improved reliability during operation. One consideration is that both the substrate part and the piezoelectric actuator part are able to be pretested to establish that they are correctly working subcomponents prior to assembly.

Further the adoption of solder as a bond or connection material is advantageous, firstly because it does not hydrolyse or dissolve in the inks as most glue bonds are found to do: also it can be reheated and repaired, if the solder connection is not properly made.

It will be appreciated that with the structure described, the unit comprising the printhead channels and their closure sheet can be replaced without replacement of the chip 27 being required. As the chip forms a significant element in the cost of the structure and as it is less vulnerable to wear and damage than the printhead channels, it is desirable that it should not have to be changed together with the printhead channels.

What is claimed is:

1. A method of manufacturing a multi-channel array droplet deposition apparatus which comprises providing a plurality of like modules; each module comprising a base sheet having a layer of piezoelectric material poled normal to said base sheet, an array of parallel, open-topped droplet liquid channels being formed in said base sheet layer so that the piezoelectric material provides upstanding walls separating successive channels, the walls defining opposed channel-facing surfaces, adjacent parallel channels being spaced apart from each other by a channel spacing, and electrodes being formed on channel-facing surfaces of the walls; butting together said plurality of like modules; providing a channel closure sheet formed with an array of parallel conductive tracks spaced at intervals corresponding with the channel spacing; locating the channels in position parallel with and opposite said tracks; sealing the closure sheet to the channel walls of more than one of said like modules by forming bonds which mechanically and electrically connect each track to the respective electrodes on the channel-facing sides of the walls of the channel opposite the tracks; providing nozzles respectively communicating with the channels and providing means for connecting a source of droplet liquid to the channels.

2. The method according to claim 1, further comprising the step of connecting drive current circuits to the tracks prior to forming said bonds.

3. The method according to claim 2, further comprising the steps of grouping drive current circuits together on a channel closure sheet and connecting the grouped drive current circuits via respective tracks to electrodes on the channel-facing walls of channels formed on different ones of said like modules.

4. The method according to claim 3, further comprising the step of providing said grouped drive current circuits in a drive chip located on the channel closure sheet.

5. The method according to claim 4, further comprising the step of forming said drive chip by deposition thereof on said closure sheet.

6. The method according to claim 1, wherein said bonds are solder bonds.

7. The method according to claim 1, wherein the closure sheet is in one piece and sealed to the channel walls of all of said like modules, thereby spanning a full width of the array.

8. The method according to claim 7, further comprising the step of connecting drive current circuits to the tracks prior to forming said bonds.

9. The method according to claim 8, further comprising the step of grouping drive current circuits together on a channel closure sheet and connecting the grouped drive current circuits via respective tracks to electrodes on the channel-facing walls of channels formed in different ones of said like modules.

10. The method according to claim 9, further comprising the step of providing said grouped drive current circuits in a drive chip located on the channel closure sheet.

11. The method according to claim 10, further comprising the step of forming said drive chip by deposition thereof on said closure sheet.

12. The method according to claim 10, further comprising the step of providing on said closure sheet a plurality of drive chips and a set of input signal tracks, the set of input signal tracks being connected to each of said drive chips.

13. The method according to claim 12, further comprising the step of forming said plurality of drive chips by deposition thereof on said closure sheet.

14. The method according to claim 7, wherein said bonds are solder bonds.

15. A multi-channel array droplet deposition apparatus comprising a plurality of like modules, each module comprising a base sheet having a layer of piezoelectric material poled normal to the base sheet, an array of parallel, open-topped, droplet liquid channels in said base sheet layer provided by upstanding channel-separating walls formed in said layer, said walls defining opposed channel-facing surfaces, adjacent parallel channels being spaced apart from each other by a channel spacing, electrodes provided on channel-facing surfaces of the walls and wherein said plurality of like modules are butted together, said apparatus further comprising a channel closure sheet bonded to the walls of more than one of said modules, nozzles respectively communicating with the channels and means for supplying droplet liquid to the channels, wherein said channel closure sheet has an array of parallel conductive tracks thereon spaced at intervals corresponding with the channel spacing, said tracks being disposed parallel with and opposite the channels and bonding mechanically and electrically connecting to the respective electrodes on the channel-facing walls of the channel opposite said tracks and sealing the closure sheet to the channels.

16. The apparatus according to claim 15, wherein drive current circuits are grouped together on said channel closure sheet and connected via respective tracks to said electrodes on the channel-facing walls of channels formed in different ones of said like modules.

17. The apparatus according to claim 16, wherein said grouped drive current circuits are located in a drive chip on the channel closure sheet.

18. The apparatus according to claim 17, wherein said drive chip is formed by deposition on said closure sheet.

19. The apparatus according to claim 15, wherein said bonds are solder bonds.

20. The apparatus according to claim 15, wherein the closure sheet is in one piece and sealed to the channel walls of all of said like modules, thereby spanning a full width of the array.

21. The apparatus according to claim 20, wherein drive current circuits are grouped together on said channel closure sheet and connected via respective tracks to said electrodes on the channel-facing walls of the channels formed in different ones of said like modules.

22. The apparatus according to claim 21, wherein said grouped drive current circuits are located in a drive chip on the channel closure sheet.

23. The apparatus according to claim 22, wherein said drive chip is formed by deposition on said closure sheet.

24. The apparatus according to claim 20, wherein a plurality of drive chips and a set of input signal tracks is provided on said cover, the set of input signal tracks being connected to each of said drive chips.

25. The apparatus according to claim 24, wherein said plurality of drive chips is formed by deposition on said closure sheet.

26. The apparatus according to claim 20, wherein said bonds are solder bonds.

27. A multi-channel array droplet deposition apparatus comprising a base sheet having a layer of piezoelectric material poled normal to the base sheet, an array of parallel, open-topped, droplet liquid channels in said base sheet layer provided by upstanding channel-separating walls formed in said layer, said walls defining opposed channel-facing surfaces, adjacent parallel channels being spaced apart from each other by a channel spacing, electrodes provided on channel-facing surfaces of the walls, a channel closure sheet bonded to the walls, nozzles respectively communicating with the channels and means for supplying droplet liquid to the channels, wherein said channel closure sheet has an array of parallel conductive tracks thereon spaced at intervals corresponding with the channel spacing, said tracks being disposed parallel with and opposite the channels and bonding mechanically and electrically connecting each track to a respective electrode on the channel-facing walls of the channel opposite said track and sealing the closure sheet to the channels, and wherein said means for supplying droplet liquid includes a manifold, said manifold being non-integral with said base sheet and said channel closure sheet.

28. The apparatus according to claim 27, wherein said manifold is attached to both said base sheet and said channel closure sheet.

29. The apparatus according to claim 28, wherein said liquid channels extend in a first direction, said manifold extending transversely to said first direction.

30. The apparatus according to claim 29, wherein said manifold is formed with an L-shaped cross-section, thereby to define together with said base sheet and said channel closure sheet a transverse duct for delivery of droplet liquid into the channels.

31. The apparatus according to claim 27, wherein said manifold is attached so as to deliver droplet liquid into the ends of said channels.

32. The apparatus according to claim 31, wherein said manifold is attached to the end of the channels.

33. The apparatus according to claim 27, wherein said apparatus further comprises drive-circuit means connected to said tracks, wherein the manifold is attached so as to lied adjacent said drive circuit means.

34. The apparatus according to claim 27, wherein said bonds are formed as solder bonds.

35. A piezoelectric ink jet print head, comprising:

a) a body of piezoelectric material having a plurality of parallel open topped channels separated by walls, said walls having metal electrodes on opposite sides thereof to form shear mode actuators for effecting droplet expulsion from the channels;

b) a top cover of insulating material having a pattern of parallel metal conductors aligned with the open tops of said channels and extending beyond said body in a direction parallel with said channels; and c) said top cover being attached to said body by solder joints between said conductors and said electrodes, and wherein said conductors provide electrical contact to said electrodes.

36. The apparatus claimed in claim 35, wherein said electrical conductors and electrodes comprise nickel and said solder joints comprise an alloy of indium.

37. The apparatus claimed in claim 35, further comprising an orifice plate over one end of said channels for ejection of droplets of ink therefrom.

38. A method of making a piezoelectric ink jet print head comprising the steps of:

a) forming a body of piezoelectric material having a plurality of parallel open topped channels separated by walls;

b) forming metal electrodes on opposite sides of said walls;

c) forming a top cover of insulating material having a pattern of parallel metal conductors congruent with the open tops of said channels;

d) coating said electrodes and said conductors with solder;

e) placing said top cover on said body; and f) heating said top cover and body to reflow said solder to bond said top to said body.

39. The method claimed in claim 38, further comprising the step of:

bonding an orifice plate over one end of said channels in said body.

40. A piezoelectric ink jet print head, comprising:

a) a sheet of piezoelectric material poled in a direction normal to said sheet and defining a plurality of parallel channels mutually spaced in an array direction normal to a length of said channels, each channel being defined by facing side walls and a bottom surface extending between the respective side walls, each of said side walls including side electrodes on opposite sides thereof to form shear mode actuators for effecting droplet expulsion from the channels, each said electrode extending along a length of the corresponding side wall; and b) a top sheet of insulating material having a pattern of parallel top electrodes formed thereof, said top electrodes being aligned with and facing tops of said channels, and being attached by solder to said side electrodes to attach said top sheet to said print head and to close said channels at the tops thereof.

41. The apparatus of claim 40, wherein said top sheet and top electrodes extend beyond said sheet of piezoelectric material in a direction parallel to said channels.

42. A method of making a piezoelectric ink jet print head, comprising the steps of:

a) forming a sheet of piezoelectric material poled in a direction normal to said sheet and defining a plurality of parallel channels mutually spaced in any array direction normal to a length of said channels, each channel being defined by facing side walls and a bottom surface extending between the respective side walls, each of said side walls including side electrodes on opposite sides thereof to form shear mode actuators for effecting droplet expulsion along a length of the corresponding side wall;

b) forming a top sheet of insulating material having a pattern of parallel top electrodes, said top electrodes being congruent with tops of said channels in said sheet of piezoelectric material; and c) bonding by reflow soldering said top sheet to said sheet of piezoelectric material such that said top electrodes are attached to respective pairs of said side electrodes to close said channels at the top thereof.

* * * * *